US009105461B2

(12) United States Patent
Gross

(10) Patent No.: US 9,105,461 B2
(45) Date of Patent: Aug. 11, 2015

(54) FLASH LAMP WITH GAS FILL FOR SUPPRESSING SELF-STARTING

(71) Applicant: VON ARDENNE GMBH, Dresden (DE)

(72) Inventor: Harald Gross, Dresden-Langebrueck (DE)

(73) Assignee: VON ARDENNE GmbH, Dresden (DE)

( * ) Notice: Subject to any disclaimer, the term of this patent is extended or adjusted under 35 U.S.C. 154(b) by 0 days.

(21) Appl. No.: 14/551,598

(22) Filed: Nov. 24, 2014

(65) Prior Publication Data

US 2015/0145401 A1 May 28, 2015

(30) Foreign Application Priority Data

Nov. 25, 2013 (DE) ..... 10 2013 112 985

(51) Int. Cl.

| | |
|---|---|
| ***H01J 11/00*** | (2012.01) |
| ***H01J 61/52*** | (2006.01) |
| ***H01J 61/80*** | (2006.01) |
| ***H01J 61/16*** | (2006.01) |
| ***H01J 61/74*** | (2006.01) |
| ***H01J 61/54*** | (2006.01) |
| ***H01J 61/32*** | (2006.01) |
| ***H01J 61/34*** | (2006.01) |

(52) U.S. Cl.

CPC ..... *H01J 61/74* (2013.01); *H01J 61/32* (2013.01); *H01J 61/34* (2013.01); *H01J 61/52* (2013.01); *H01J 61/547* (2013.01); *H01J 61/80* (2013.01)

(58) Field of Classification Search

None

See application file for complete search history.

(56) References Cited

U.S. PATENT DOCUMENTS

| | | | | |
|---|---|---|---|---|
| 2,656,478 | A | 10/1953 | Friedman | |
| 2,732,513 | A | 1/1956 | Anderson et al. | |
| 4,074,208 | A | 2/1978 | Mack et al. | |
| 4,260,934 | A * | 4/1981 | Kuus et al. | 315/326 |
| 4,418,300 | A * | 11/1983 | Otani et al. | 313/573 |
| 4,491,766 | A * | 1/1985 | Larson | 315/60 |
| 5,420,481 | A * | 5/1995 | McCanney | 315/291 |
| 6,191,539 | B1 * | 2/2001 | Green | 315/249 |
| 6,198,223 | B1 * | 3/2001 | Scholz | 313/623 |
| 2004/0004441 | A1 * | 1/2004 | Yano | 315/169.1 |
| 2007/0138960 | A1 * | 6/2007 | Karrs et al. | 313/594 |

FOREIGN PATENT DOCUMENTS

| | | | |
|---|---|---|---|
| DE | 2248132 | A1 | 4/1973 |
| DE | 2633550 | A1 | 3/1977 |
| DE | 2653586 | A1 | 6/1978 |
| DE | 202011106953 | U1 | 1/2012 |
| EP | 0105230 | A2 | 4/1984 |
| GB | 1555546 | A | 11/1979 |
| WO | 2013106076 | A1 | 7/2013 |

* cited by examiner

*Primary Examiner* — Ashok Patel

(74) *Attorney, Agent, or Firm* — Heslin Rothenberg Farley & Mesiti P.C.

(57) ABSTRACT

A flash lamp with a gas fill for suppressing self-starting includes an elongate discharge tube having two electrodes arranged in the discharge tube at opposite ends of the discharge tube. A starting electrode for applying a starting voltage is arranged outside the discharge tube, and the discharge tube has a length of at least 1000 mm and is filled with a gas fill. In order to suppress undesired self-starting, the discharge tube is filled with a gas mixture which contains at least one inert gas and at least one gas suppressing self-starting.

14 Claims, 1 Drawing Sheet

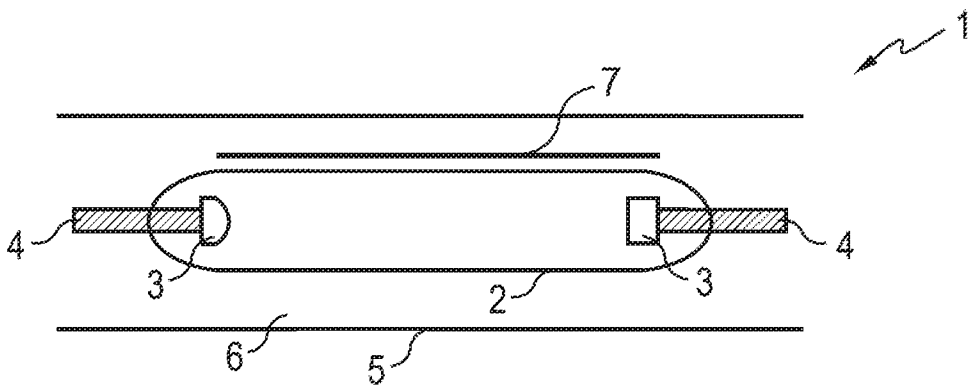
1
7
4
3
2
5
6
3
4

FLASH LAMP WITH GAS FILL FOR SUPPRESSING SELF-STARTING

CROSS REFERENCE TO RELATED APPLICATIONS

This application claims priority of German application DE 10 2013 112 985.4 filed on Nov. 25, 2013, the entire contents of which is hereby incorporated by reference herein.

BACKGROUND ART

The invention relates to a flash lamp with a gas fill for suppressing self-starting, comprising an elongate discharge tube having two electrodes arranged in the discharge tube at opposite ends of the discharge tube, wherein a starting electrode, to which a starting voltage can be applied, is arranged outside the discharge tube, and wherein the discharge tube has a length of at least 1000 mm and is filled with a gas fill.

In order to start an axial flash lamp with a length which is orders of magnitude greater than the diameter, consisting of a discharge tube with two electrodes (cathode and anode), generally three different methods are used, namely series, parallel or external starting. In the case of series or parallel starting, a transformer is connected in series or in parallel with the electrodes of the flash lamp and a high-voltage pulse or a starting voltage is supplied to the electrodes. The starting-voltage field leads to gas ionization in the flash lamp. Thus, owing to the field strength, an avalanche-like multiplication of the free charge carriers in the flash lamp takes place.

Since the required starting voltage increases with the lamp length in the case of series or parallel starting, a very high starting voltage or a very large and more expensive transformer is required for long flash lamps. In order to avoid such a large transformer, a long flash lamp is typically started externally, i.e. a starting electrode is fitted on the outer side of the flash lamp and a starting voltage is applied to said starting electrode. After starting, the gas discharge is maintained with an operating voltage at the electrodes.

In practice, however, self-starting of the flash lamp can occur, i.e. starting of the flash lamp is not caused by means of the starting voltage but by an undesired, parasitic electric field, for example. This self-starting is uncontrollable and should be prevented in various applications since it changes light exposure processes, for example.

For example, the spacing between the cathode and the anode is sufficiently large in the case of a flash lamp cooled by water with a length of, for example, 4000 mm with a filling pressure of, for example, 400 mbar, with the result that the required voltage for self-starting is far above the operating voltage of 10-45 kV. Even voltage differences of 70 kV between the cathode and the anode are insufficient for causing self-starting.

If, however, electrically conductive surfaces are applied in the vicinity of the flash lamp, for example a starting electrode in the form of a starting wire, which is used for external, controlled starting of the flash lamp, the self-starting voltage is reduced to values below 20 kV. The closer the starting wire is to the flash lamp, the more reliable the desired controlled starting of the flash lamp becomes, but also the self-starting voltage decreases with the spacing. This latter fact is explained by the acceleration of natural electrons in the flash lamp towards the starting wire which release secondary electrons on the glass wall of the flash lamp and cause an avalanche effect. Even in the case of a potential-free starting wire, for example connection of the starting wire via a capacitor to ground potential, an avalanche effect is provoked by the physical vicinity in combination with creeping discharges or leakage currents.

BRIEF SUMMARY OF THE INVENTION

The invention is therefore based on the object of specifying a flash lamp with a specific gas fill with which the self-starting voltage can be increased in the case of a cooled, long flash lamp and therefore undesired self-starting can be avoided.

The invention is based on a flash lamp which consists of an elongate discharge tube filled with a gas fill and having two electrodes (cathode, anode), which are arranged in the discharge tube at opposite ends of the discharge tube, wherein a starting electrode for applying a starting voltage is arranged outside the discharge tube. The starting electrode is preferably elongate and runs parallel to the flash lamp axis. The discharge tube typically has a length of at least 1000 mm, preferably a length of at least 2000 mm.

The discharge tube is surrounded on the outside by a tubular jacket, which is spaced apart from the discharge tube, for accommodating a cooling medium. In this case, for example, deionized cooling water is used as cooling medium for cooling the discharge tube. The interspace between the discharge tube and the tubular jacket is filled with the cooling water. The cooling water in this case flows through the interspace between the discharge tube and the tubular jacket. The tubular jacket can be produced with circular, rectangular, oval or other cross sections.

Such a long flash lamp is typically used for exposing substrates to light in a treatment chamber, in particular in a vacuum chamber, and can be formed with a reflector, for example. The operating voltage for operating the flash lamp is typically in the region of several kilovolts, wherein the operating voltage, as a first approximation, rises linearly with the lamp length. Typically, the operating voltage of the flash lamp with a length of at least 1000 mm is above 10 kV. In the case of flash lamps with a lamp length of approximately 4000 mm, the operating voltage can be 10 kV-50 kV, for example.

In the case of application of a high operating voltage or charging voltage at an electrode, increased electrical field strengths occur on the outer side of the discharge tube, in particular the outer side of the discharge tube in the region of the electrode, owing to a high potential difference between the electrode to which the high operating voltage is applied and the electrically conductive immediate environment of the electrode, for example a chamber wall. This increase in field intensity can result in an electron avalanche between the electrode and the surrounding environment and, as a result, in self-starting of the flash lamp. This increase in electrical field strength can be referred to as self-starting voltage.

If water is used instead of air as cooling medium between the discharge tube and the tubular jacket, the self-starting voltage decreases significantly owing to the increased permittivity of the water of approximately 81 in comparison with that of air of approximately 1.

In accordance with the invention, in order to suppress this undesired self-starting, the discharge tube is filled with a gas mixture, which contains at least one inert gas and at least one gas suppressing self-starting.

The flash lamp can be filled with xenon or krypton or a mixture thereof as inert gas.

The gas suppressing self-starting has a smaller active cross section for impact ionization than the inert gas. The active cross section is a measure of the probability of electron impact ionization, i.e. the probability of impacts between electrons and atoms or molecules. By virtue of the interaction of the electron with the atom or molecule, sufficient energy can be transferred to ionize one or more atoms or molecules.

For example, nitrogen can be admixed to the inert gas in order to suppress self-starting. Owing to the smaller active cross section of the nitrogen molecule in comparison with the atomic inert gas, the probability of an electron avalanche between the electrode and the electrically conductive environment is reduced. This reduction then results in an increase in the self-starting voltage.

In order to suppress self-starting of the flash lamp, alternatively oxygen or hydrogen can be admixed to the inert gas.

A further alternative for suppressing self-starting is to add a mixture of nitrogen and oxygen or a mixture of nitrogen and hydrogen to the inert gas.

The content of the gas suppressing self-starting in the gas mixture is from 1 to 10% by volume (vol. %) in the case of a total filling pressure of from 50 to 1000 mbar. Preferably, the content in the gas mixture is from 2 to 5 vol. %.

The addition of a few percentage points of nitrogen or oxygen or hydrogen to the gas fill can significantly suppress self-starting of the flash lamp. However, the addition should remain as a small quantity so that normal starting of the flash lamp, i.e. starting by means of a preset starting voltage, is not changed significantly. The object of the invention is also achieved by the use of a gas mixture as fill for the flash lamp which contains at least one inert gas and at least one gas suppressing self-starting which has a smaller active cross section for impact ionization than the inert gas. The use according to the invention of the gas mixture in a flash lamp, comprising an elongate discharge tube having two electrodes arranged in the discharge tube and one starting electrode arranged outside of the discharge tube, wherein the discharge tube is surrounded on the outside by a tubular jacket, which is spaced apart from the discharge tube, for accommodating a cooling medium, wherein the discharge tube has a length of at least 1000 mm, shows that suppressing of self-starting is thus achieved.

For example, in the case of a gas mixture with 97 vol. % xenon and an admixture of 3 vol. % nitrogen in the case of a total filling pressure of from 50 to 1000 mbar, the required voltage for self-starting or the self-starting voltage can be increased by approximately 1.5 times, owing to the smaller active cross section of the nitrogen molecule.

For example, in the case of a gas mixture with 95 vol. % xenon and an admixture of 5 vol. % nitrogen, the required self-starting voltage can be increased at least two fold.

BRIEF DESCRIPTION OF THE DRAWING FIGURES

The invention will be explained in more detail below with reference to exemplary embodiments and an associated drawing, in which:

FIG. 1 shows a schematic illustration of a flash lamp according to the invention.

DETAILED DESCRIPTION

FIG. 1 shows a flash lamp 1, which consists of a gas-filled discharge tube 2 having two electrodes 3. The discharge tube 2 is typically produced from quartz glass, and the electrodes 3 are produced from tungsten. The spacing between the electrodes 3 is typically greater than 2000 mm. The discharge tube 2 is surrounded on the outside by a tubular jacket 5 for accommodating cooling water or cooling air. The cooling water or cooling air flows through the interspace 6 between the discharge tube 2 and the tubular jacket 5.

The electrodes 3 are each connected to a connection line 4, which is located in the cooling water. A starting electrode 7, for example a starting wire 7, is fitted outside the discharge tube 2 for applying a starting voltage.

In the case where an operating voltage is applied to the electrode 3, but the starting voltage is not applied to the starting electrode 7, but is at ground potential, for example, the flash lamp 1 can self-start owing to an electrode avalanche between the electrode 3 and the starting electrode 7 since a parasitic increase in the electrical field strength is produced between the electrode 3 and the starting electrode 7.

In order to reduce this self-starting, the discharge tube in a first exemplary embodiment is filled with 95 vol. % xenon with an admixture of 5 vol. % nitrogen in the case of a total filling pressure of 400 mbar. This admixture has shown, in experiments, that the required voltage for self-starting increases from below 20 kV to above 48 kV. The nitrogen has a smaller active cross section in comparison with xenon, with the result that, owing to the nitrogen, the probability of an electron avalanche between the electrode 3 and the surrounding environment or the starting electrode 7 is reduced.

The self-starting voltage can also be reduced significantly by rapidly changing, also weak, fields, for example caused by small discharges between high-voltage feed lines via air to grounded component parts. Therefore, in a further exemplary embodiment, a low-pass filter can be connected to the electrode, with the result that the self-starting voltage is not influenced by the discharges.

The invention claimed is:

1. A flash lamp comprising an elongate discharge tube having two electrodes arranged in the discharge tube at opposite ends of the discharge tube and to which an operating voltage can be applied, and having a starting electrode arranged outside the discharge tube and to which a starting voltage can be applied, wherein the discharge tube is surrounded on an outside by a tubular jacket spaced apart from the discharge tube, for accommodating a cooling medium, wherein the discharge tube has a length of at least 1000 mm and is filled with a gas fill comprising a gas mixture containing at least one inert gas and at least one gas suppressing self-starting, the at least one gas suppressing self-starting having a smaller active cross section for impact ionization than the inert gas.

2. The flash lamp according to claim 1, wherein the at least one gas suppressing self-starting comprises nitrogen.

3. The flash lamp according to claim 1, wherein the at least one gas suppressing self-starting comprises hydrogen.

4. The flash lamp according to claim 1, wherein the at least one gas suppressing self-starting comprises a mixture of nitrogen and hydrogen.

5. The flash lamp according to claim 1, wherein content of the at least one gas suppressing self-starting in the gas mixture is from 1 to 10% by volume (vol. %).

6. The flash lamp according to claim 1, wherein content of the at least one gas suppressing self-starting in the gas mixture is from 2 to 5 vol. %.

7. The flash lamp according to claim 1, wherein an interspace between the tubular jacket and the discharge tube is filled with cooling water.

8. The flash lamp according to claim 1, wherein an interspace between the tubular jacket and the discharge tube is filled with cooling air.

9. The flash lamp according to claim 1, wherein the operating voltage is in a region of several kilovolts.

10. A method for increasing a self-starting voltage and therefore suppressing self-starting of a flash lamp, the flash lamp including an elongate discharge tube having two electrodes arranged in the discharge tube and a starting electrode arranged outside the discharge tube, wherein the discharge tube is surrounded on an outside by a tubular jacket spaced apart from the discharge tube for accommodating a cooling medium, and wherein the discharge tube has a length of at least 1000 mm, the method comprising: filling the discharge tube with a gas mixture as gas fill, the gas mixture containing at least one inert gas and at least one gas suppressing self-starting, the at least one gas suppressing self-starting having a smaller active cross section for impact ionization than the inert gas.

11. The method according to claim 10, wherein the at least one gas suppressing self-starting comprises nitrogen or hydrogen or a mixture thereof.

12. The method according to claim 10, wherein content of the at least one gas suppressing self-starting in the gas mixture is from 1 to 10% by volume (vol. %).

13. The method according to claim 10, wherein content of the at least one gas suppressing self-starting in the gas mixture is from 2 to 5% by volume (vol. %).

14. The method according to claim 10, wherein the discharge tube is filled with 95 vol. % xenon and an admixture of 5 vol. % nitrogen, whereby the self-starting voltage is increased from below 20 kV to above 48 kV.

* * * * *